United States Patent [19]

Hansen et al.

[11] Patent Number: 4,834,613

[45] Date of Patent: May 30, 1989

[54] RADIALLY CONSTRAINED VARIABLE VANE SHROUD

[75] Inventors: Lee E. Hansen; William R. Ulrich, both of Lake Park, Fla.

[73] Assignee: United Technologies Corporation, Hartford, Conn.

[21] Appl. No.: 161,561

[22] Filed: Feb. 26, 1988

[51] Int. Cl.[4] ..... F04D 29/46

[52] U.S. Cl. ..... 415/160; 415/189

[58] Field of Search ..... 415/134, 137, 138, 139, 415/149 R, 160, 161, 162, 189, 190, 216-218

[56] References Cited

U.S. PATENT DOCUMENTS

| | | | |
|---|---|---|---|
| 2,671,634 | 3/1954 | Morley | 415/160 |
| 2,859,934 | 11/1958 | Halford et al. | 415/137 X |
| 2,950,084 | 8/1960 | Perry | 415/160 |
| 3,262,677 | 7/1966 | Bobo et al. | 415/218 |
| 3,284,048 | 11/1966 | Tumavicus | 415/160 |
| 3,314,654 | 4/1967 | Thenault et al. | 415/160 |
| 3,318,513 | 5/1967 | Johnson | 415/161 |
| 3,326,523 | 6/1967 | Bobo | 415/218 |
| 3,352,537 | 11/1967 | Petrie | 415/160 X |
| 3,878,677 | 4/1975 | Colvin | 60/39.14 |
| 3,937,013 | 2/1976 | Aspinwall | 60/226 |
| 3,966,352 | 6/1976 | White et al. | 415/115 |
| 3,990,810 | 11/1976 | Amos et al. | 415/161 |
| 3,992,128 | 11/1976 | Lunsford et al. | 415/161 |
| 3,999,883 | 12/1976 | Nordenson | 415/113 |
| 4,013,377 | 3/1977 | Amos | 415/161 |
| 4,025,227 | 5/1977 | Greenberg et al. | 415/160 |
| 4,135,362 | 1/1979 | Glenn | 60/39.16 |
| 4,187,054 | 4/1980 | Landis, Jr. et al. | 415/115 |
| 4,214,851 | 7/1980 | Tuley et al. | 415/115 |
| 4,278,398 | 7/1981 | Hull | 415/160 |
| 4,307,994 | 12/1981 | Brewer | 415/160 |
| 4,325,673 | 4/1982 | Hall, Jr. | 415/113 |
| 4,585,390 | 4/1986 | Pirtle et al. | 415/217 X |

FOREIGN PATENT DOCUMENTS

| | | | |
|---|---|---|---|
| 1183012 | 7/1959 | France | 415/217 |

*Primary Examiner*—Robert E. Garrett
*Assistant Examiner*—Joseph M. Pitko
*Attorney, Agent, or Firm*—Harry J. Gwinnell

[57] ABSTRACT

An inner shroud for a gas turbine engine is described comprising six approximately equiangular segments each segment adapted to securely contain a plurality of vane stems. The segments comprise interlocking first and second sections forming a channel having an aperture suitably sized to securely contain the vane stem. The sections when fit together form an outer recess area suitably sized to substantially accommodate the button portion of the vane stem and an inner cavity suitably sized to accommodate the inner portion of the vane stem. This results in reduced shroud curling when used in a split case compressor.

4 Claims, 3 Drawing Sheets

FIG. 2
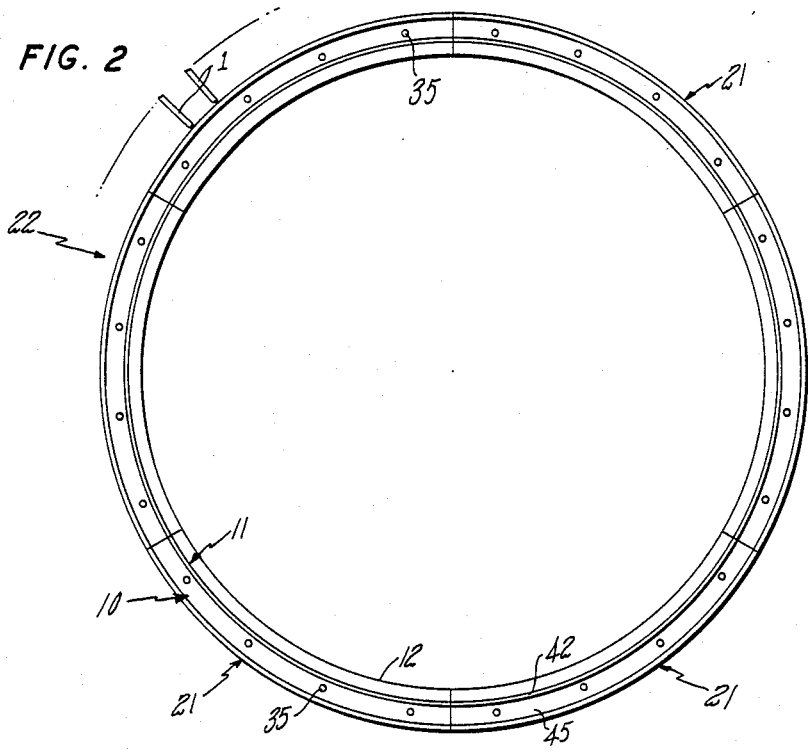
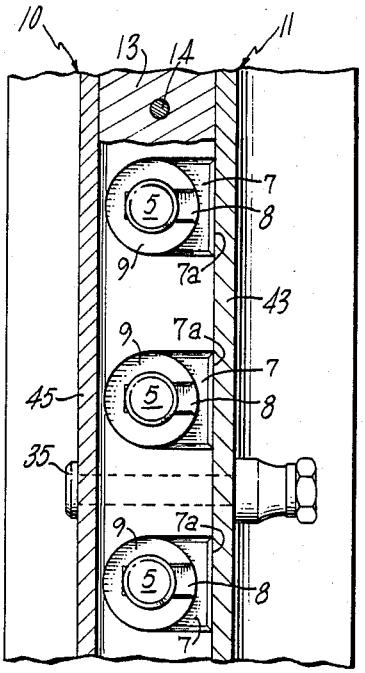
FIG. 3

RADIALLY CONSTRAINED VARIABLE VANE SHROUD

The Government has rights in this invention pursuant to a contract awarded by the Department of the Air Force.

DESCRIPTION

1. Technical Field

This invention pertains to gas turbine engines and more particularly to variable vane shrouds for use in such engines.

2. Background Art

In recent years the use of an axially split compressor case has come into vogue because of the advantages it provides. For example, the use of an axially split compressor case allows for the use of a welded drum rotor. It also facilitates replacements of rotor blades in the field. One of the problems with such a split compressor is the tendency for the shrouds in the compressor to curl. In operation a radial temperature differential can be produced across the shrouds. This leads to differential expansion of the shroud. A full hoop resists this deformation, but a segmented hoop does not.

Accordingly, designers in this art are motivated to improve shroud performance in this environment while continuing to capitalize on the advantages the use of a split compressor case provides.

DISCLOSURE OF INVENTION

An inner shroud is described comprising six approximately equiangular segments. Each segment is adapted to securely contain a plurality of vane stems. Each segment is made up of interlocking forward and aft sections comprising sidewall portions and inner and outer wall portions. When the sections fit together they form (radially) an inner channel and an outer channel. The outer channel is configured so as to recess the vane buttons for smoother air flow and the inner channel configured so as to securely constrain the inner portion of the vane stem.

Another aspect of the invention is a gas turbine engine variable vane assembly comprising the above shroud where the vane stem is secured in the inner channel by means of a bushing, a washer, and a spring clip. The use of such a shroud in this environment eliminates shroud end curling in the split case design.

The foregoing and other features and advantages of the present invention will become more apparent from the following description and accompanying drawings.

BRIEF DESCRIPTION OF DRAWINGS

FIG. 2 shows the segmented portions of the vane.

FIG. 3 is a sectional view taken along the line 3—3 of FIG. 1.

BEST MODE FOR CARRYING OUT THE INVENTION

In the shroud according to the present invention the shroud segments are radially constrained. This is necessary since outward movement of the shroud would interfere with the vane operation and inward movement of the shroud would interfere with the rotating knife edge seal. At the same time, the shroud must be configured so as to permit movement of the variable vanes to accommodate changes in pressures and airflow.

Figure 1:
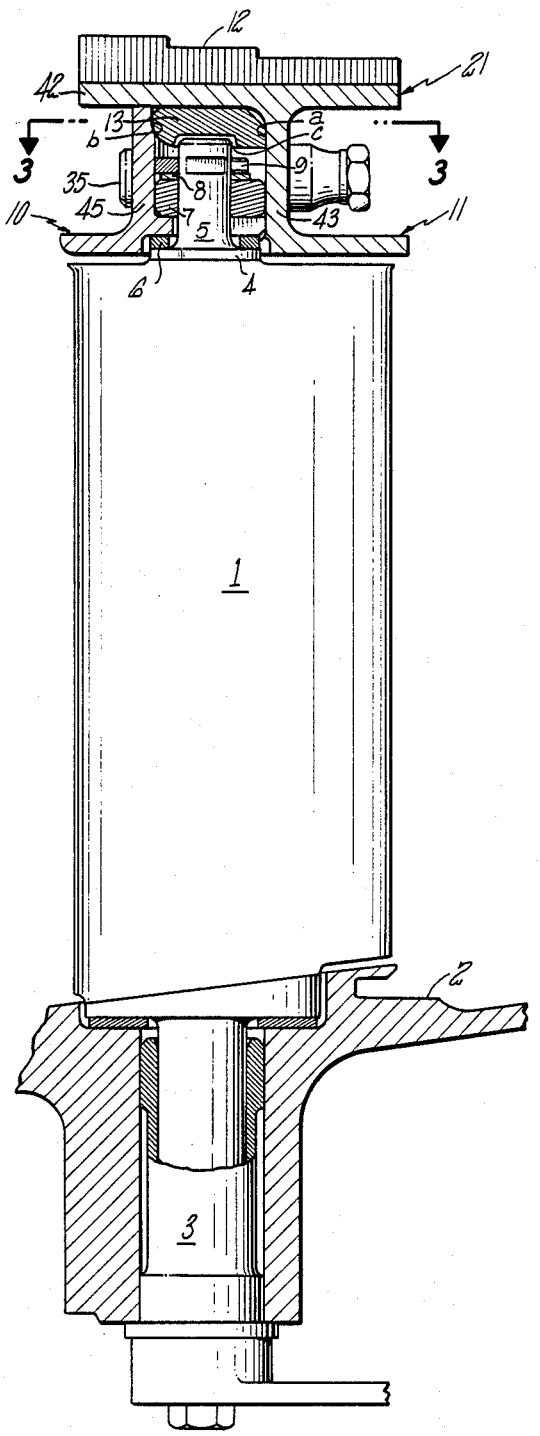
FIG. 1 shows the shroud according to the present invention containing the vane.

In FIG. 1 the vane 1 is secured to the split case 2 through the bushing 3. This is a conventional vane support system. The inner (radially) part of the vane contains a conventional as-cast button 4 and vane stem 5. Next to the button is a washer 6, a bushing 7, a washer 8 and a clip 9. In FIG. 1, the bushing 7 prevents radial movement of the shroud outward and the washer 6 prevents radial movement of the shroud inward.

The system of washers, bushing and clip above described assists in securing the vane stem to the shroud. This is necessary to capture the shroud radially, since, being segmented, there is no full ring to hold it. The shroud segments are made up of two interlocking parts 10 and 11. Next to the shroud is a conventional honeycomb seal 12.

An end view of the shroud 22 of the present invention can be seen in FIG. 2. The shroud 22 is comprised of six approximately equiangular sections 21. The number of segments is determined by the smallest number of segments which could be used while eliminating the thermal expansion and contraction problems produced. Each segment represents an approximately 60° angular portion of the shroud, ±2° to accommodate the spacing of the vanes. The half ring 13 in FIG. 1 is shaped as to substantially fill the channel in which it sits to produce minimum forward and aft shifting of the shroud, i.e. increased stiffness. The ring covers half of the circumference of the shroud, a two-piece ring therefore encircling the entire shroud. As stated above, the ring is shaped so as to substantially fill the channel it occupies preferably contacting the shroud wall segments at points a and b in FIG. 1. The ring also has a recess section c to reduce or prevent friction of the vane stem and allow free movement of the vane when called for. The thickness of the ring is such as to basically fill the available space between the stem and the shroud wall, although the thickness would not necessarily have to completely fill this area. The two half rings are split at the same point that the compressor case would split.

In order to prevent sliding movement of this ring 13 there are securing pins 14 on each half of the shroud determined by the split in the compressor case. Movement of the split ring could cause problems if the case is opened at its split points. A close tolerance hole is drilled in one of the wall portions of the shroud segments and the securing pins 14 forced into the hole. The pin is made of the same material as the shroud material. Ideally the first pin is placed in the middle of the split segment and the second pin located directly diagonally across from the first pin. Recession holes to fit the pins are also drilled in the ring to accommodate the pin.

FIG. 3 shows more closely the vane interlocking system in the shroud segments where the bushing 7 is anti-rotated due to its flat surface 7*a* and the washer 8 is used to separate the bushing from the securing clip 9 to prevent the clip from wearing on the bushing surface. Hi-Shear TM fastener 35 holds the forward and aft pieces of the shroud segment together. The c-shaped clip 9 matches the design of the cavity so that even if the clip releases from the vane stem it will have very small movement in the cavity and still serve the purpose of retaining the vane stem. There are typically 4 bolt holes for the fastener 35. The holes are shown as 23 in FIG. 4. The 4 bolt holes mentioned above are per segment. The bolt holes would be equally spaced except in the case where they would be in conflict with a vane in which case they would be moved to accommodate the vane and they would be moved (most likely) in pairs.

Figure 4:
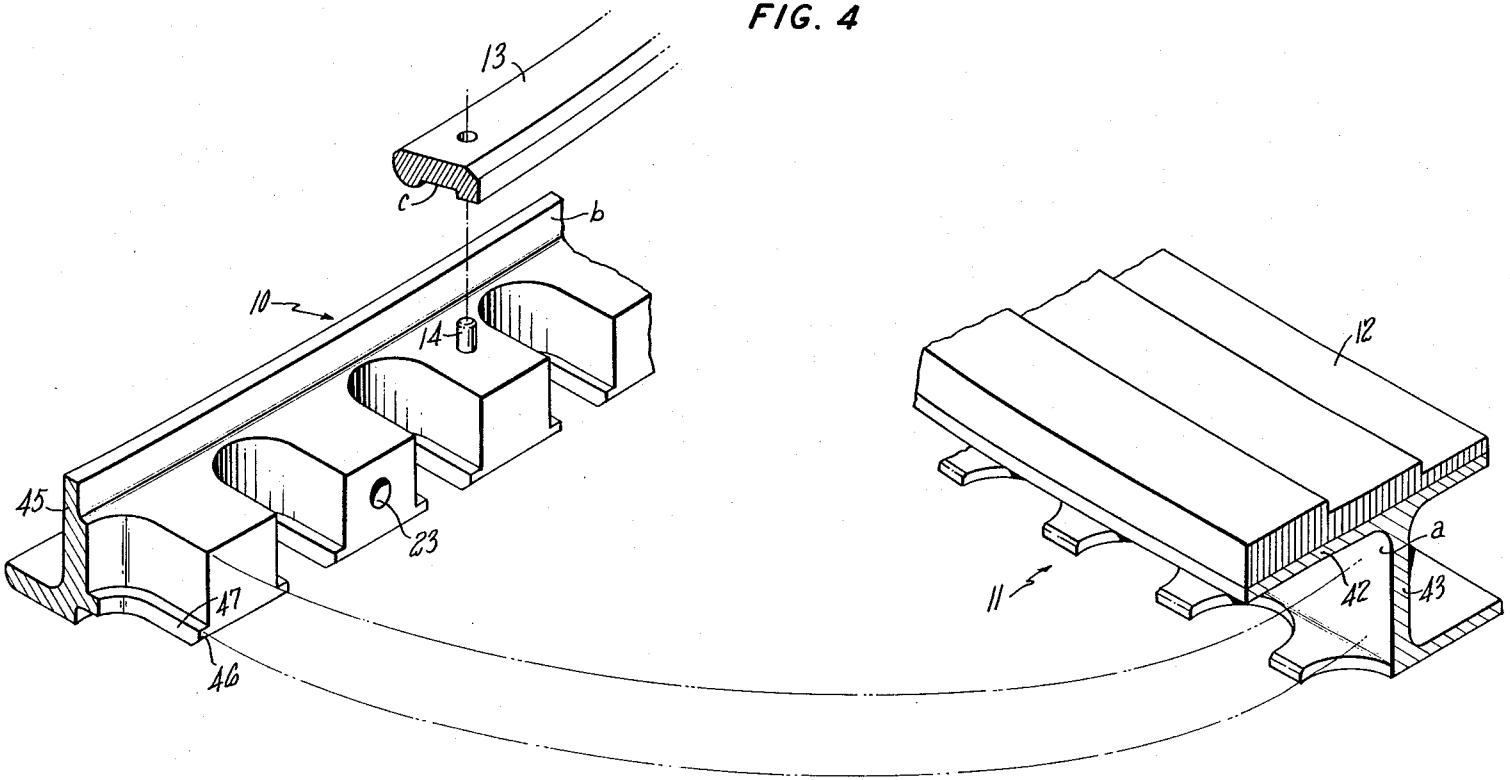
FIG. 4 is a exploded perspective view showing positions of the segments making up the shroud.

FIG. 4 is another view of the interlocking shroud channel members. Section 11 provides an inner wall portion 42 and a side wall portion 43 which interlocks with a second segment 10, having a side wall portion 45 and an outer wall portion 46 with apertures 47 provided for the vane stems.

The inner shroud is specifically adapted to be used with a split case compressor. The use of a split case compressor requires a shroud which must come apart as well. A two-piece split shroud could deform with heating to the extent of interfering with the normal operation of the vanes or knife edge seals. As mentioned above, the shroud should be broken into 6 approximately equiangular pieces which are short enough so that the temperature deflection is not a problem. They are secured at the bottom to the vane stem and at the top through the knife edge seal and located radially with washers. The six-piece configuration produces negligible shrinkage and expansion.

The shroud is particularly adapted for use with the variable vane stages of the gas turbine engine. For example, in the F-100 PW229 these stages are the 4th, 5th, and 6th stages. In other engines they could obviously accommodate other stages as well.

The two-segment version mentioned above is basically constrained. The use of the washer and bushing arrangement allows the vane to constrain the shroud radially. Also the channel configuration produced by interlocking of the segments further restricts parts for movement should problems occur. The flat side of the bushing seats against the flat side of the shroud wall such that the bushing does not rotate, resulting in less bushing wear. And, as mentioned above, all vane stem hardware parts are retained within the shroud cavity if failure should occur, preventing parts from entering the flow path and causing damage. This configuration also allows for smoother air flow over the shroud because of the recess. The recess allows the vane button to be flush with the (radially) outer surface of the shroud. The shroud itself is made of conventional nickel alloy and the bushing is made of graphite polyimide which provides good lubrication for reducing wear on the vane stem.

It should also be noted that the half ring 13 in FIG. 1 prevents forward and aft shifting of segments within the split case. This prevents possible contact of the shroud segments with the rotating hardware on either side of the shroud walls.

This design eliminates shroud end curling. It also offers a practical segmented variable vane shroud. The bushings are anti-rotated providing for better wear resistance. The vane buttons are in circular recesses providing for better airflow. The stem, washer and clip are retained in the shroud preventing entry into the flow path should failure occur. The composite bushing serves as a radial thrust washer providing lubrication when vane and shroud are pushed together radially.

The metal material is used for the shroud segments are those conventional in this art. For example, the channel forming portions of the shroud are conventional nickel alloy such as IN625. The vane material is conventional nickel alloy such as IN718. The clip is made of similar nickel alloy and the washer conventional stainless steel. The bushing materials are typically made of Polybon-L TM material which is a graphite fiber reinforced polyimide.

Although this invention has been shown and described with respect to detailed embodiments thereof, it will be understood by those skilled in the art that various changes in form and detail thereof may be made without departing from the spirit and scope of the claimed invention.

We claim:

1. An inner shroud for a gas turbine engine comprising:

six approximately equiangular segments;

each segment adapted to securely contain a plurality of variable vane stems;

said segment comprising interlocking first and second sections, the first section having a first side wall portion and an outer wall portion, the outer wall portion having an aperture suitably sized to securely contain the vane stem, and the second section having a second side wall portion and an inner wall portion, the sections when fit together forming an outer recess area suitably sized to substantially accommodate the outer portion of the vane stem, and an inner cavity area suitably sized to accommodate the inner portion of the vane stem.

2. A gas turbine engine variable vane assembly comprising six approximately equiangular segments;

each segment adapted to securely contain a plurality of vane stems;

said segment comprising interlocking first and second sections, the first section having a first side wall portion and an outer wall portion, the outer wall portion having an aperture suitably sized to securely contain the vane stem, and the second section having a second side wall portion and an inner wall portion, the sections when fit together forming an outer recess area suitably sized to substantially accommodate the outer portion of the vane stem, and an inner cavity area suitably sized to accommodate the inner portion of the vane stem, the vane stem secured in the inner cavity by means of a bushing surrounding the vane stem and next to the outer wall portion, a washer surrounding the vane stem and next to the bushing, a clip securely fastened to and surrounding the vane stem, a spacer next to the clip and surrounding and on top of the vane stem substantially filling the remaining available space in the inner cavity area resulting in reduced shroud curling in a split case compressor.

3. The apparatus of claim 2 wherein the bushing is anti-rotated.

4. The assembly of claim 2 including a split ring in the shroud substantially filling the inner cavity above the vane stem.

* * * * *